United States Patent [19]

Kuhn

[11] 3,984,016

[45] Oct. 5, 1976

[54] ATTACHMENT MOUNTING FOR END LOADER

[75] Inventor: Patrick Kuhn, Grundy Center, Iowa

[73] Assignee: Clark Equipment Company, Buchanan, Mich.

[22] Filed: Nov. 4, 1974

[21] Appl. No.: 520,706

[52] U.S. Cl. ..... 214/131 A; 214/145 A; 214/152

[51] Int. Cl.[2] ..... E02F 3/72

[58] Field of Search ..... 214/131 A, 130 R, 145, 214/140, 620, 138 R, DIG. 5, 152

[56] References Cited

UNITED STATES PATENTS

| | | | |
|---|---|---|---|
| 3,471,033 | 10/1969 | Drury | 214/130 |
| 3,612,311 | 10/1971 | Eidy | 214/131 A |
| 3,732,996 | 5/1973 | Bauer | 214/131 A |
| 3,753,508 | 8/1973 | Carpenter | 214/130 |
| 3,805,980 | 4/1974 | Kisaka | 214/131 A |

FOREIGN PATENTS OR APPLICATIONS

| | | | |
|---|---|---|---|
| 1,924,269 | 11/1970 | Germany | 214/131 A |

*Primary Examiner*—L. J. Paperner
*Assistant Examiner*—Ross Weaver
*Attorney, Agent, or Firm*—Harry G. Thibault

[57] ABSTRACT

A method and mounting by which the lift arms of a tractor vehicle having a material handling bucket may be converted to other uses by removing the bucket and mounting in its place an attachment, such as a backhoe. The attachment is lifted and transferred to a working position by the lift arms which also support the attachment. A latch locates and locks the lift arm and attachment in a fixed position in relation to the tractor.

7 Claims, 12 Drawing Figures

ATTACHMENT MOUNTING FOR END LOADER

BACKGROUND OF THE INVENTION

1. Field of the Invention

This invention pertains to the art of material handling vehicles and more specifically to a tractor loader having lift arms carrying a bucket or other tool. An attachment mounting frame pivots on the lift arms and is adapted to couple with various attachments.

2. Description of the Prior Art

A tractor loader vehicle of the type to which the present invention pertains is disclosed in U.S. Pat. No. 3,372,996; inventor, James J. Bauer; issued 15 May 1973 and assigned to the assignee of the present invention. Such a vehicle will often be referred to as an end loader when equipped with a bucket or other material handling shovel. The lift arms, however, have a pivoted mounting frame at their forward ends which is capable of mounting various attachments other than a bucket thus converting the vehicle to other uses. A prime example is a backhoe.

In the method employed according to this patent, the backhoe will have a carrier which is engaged by the pivoted mounting frame on the end of the lift arms. A pair of lift cylinders for raising and lowering the arms are actuated to lower the mounting frame behind the carrier. Tilt cylinders on the lift arms pivot the mounting frame providing a second degree of motion to the frame. By manipulating the lift and tilt cylinders, the backhoe can be lifted and tilted while being transferred to a working position on the front of the machine. A mounting frame of the type referred to is disclosed in U.S. Pat. No. 3,672,521, Bauer et al, issued June 27, 1972 which is also assigned to the assignee of the present invention.

SUMMARY OF THE INVENTION

The present invention differs from the method and mounting in the above U.S. Pat. No. 3,732,996 in that the mounting frame and lift arms continue to support the attachment in the working position rather than the weight of the attachment being transferred to the vehicle body.

A latch locates and locks the lift arms and attachment in a fixed position in relation to the machine.

The latch comprises a lug and hook arrangement whereby the carrier is located by lowering it at the front of the machine until connection is made with a fixed hook or lug on the front of the tractor.

A lever is accessible to the operator from his station on the machine for operating a closure locking the hook and lug in fixed relationship to each other.

In one embodiment a pair of hooks is mounted on the vehicle frame and mating lugs are formed by a horizontal bar secured between the ends of spaced structure on the carrier. The horizontal bar carries a pair of rotatable sleeves at opposite ends which are formed with U-shaped closures that can be rotated around the hooks on the machine to positively lock the attachment and lift arms.

In another embodiment a pair of lugs on the front of the tractor engage hooks on the attachment carrier. A pivoted closure hook on the carrier hook is pulled by a tension spring toward the locking position after the connection is made.

The invention also is considered embodied in the method which includes the steps of lifting an attachment using the lift and tilt cylinders of a tractor loader positioning the attachment at the end of the vehicle within reach of the operator's station and latching the attachment onto the vehicle without transferring its weight from the lift arms and mounting frame.

An advantage of this invention is that the attachment is both lifted and transported by the lift arms and is supported in the working position by the lift arms. This obviates the need of transferring the weight of the attachment to the vehicle. Where the weight of the attachment is considerable, as with a backhoe, considerable dexterity on the part of the operator is required to manipulate and quickly mount such an object if a load transfer function is involved. Whereas in the present invention, once lifted, the load is continuously supported in the working position by the same structure; namely, the lift arms and mounting frame. This results in a much faster mounting and dismounting operation.

It is also a feature with the compact skid-steered loaders where the operator is close to the mounting or work position, that the latching function can be performed without his leaving the operator's station.

These and other advantages will be more apparent by referring to the following detailed description which proceeds with a description of the drawings wherein:

DESCRIPTION OF THE PREFERRED EMBODIMENT

Figure 1:
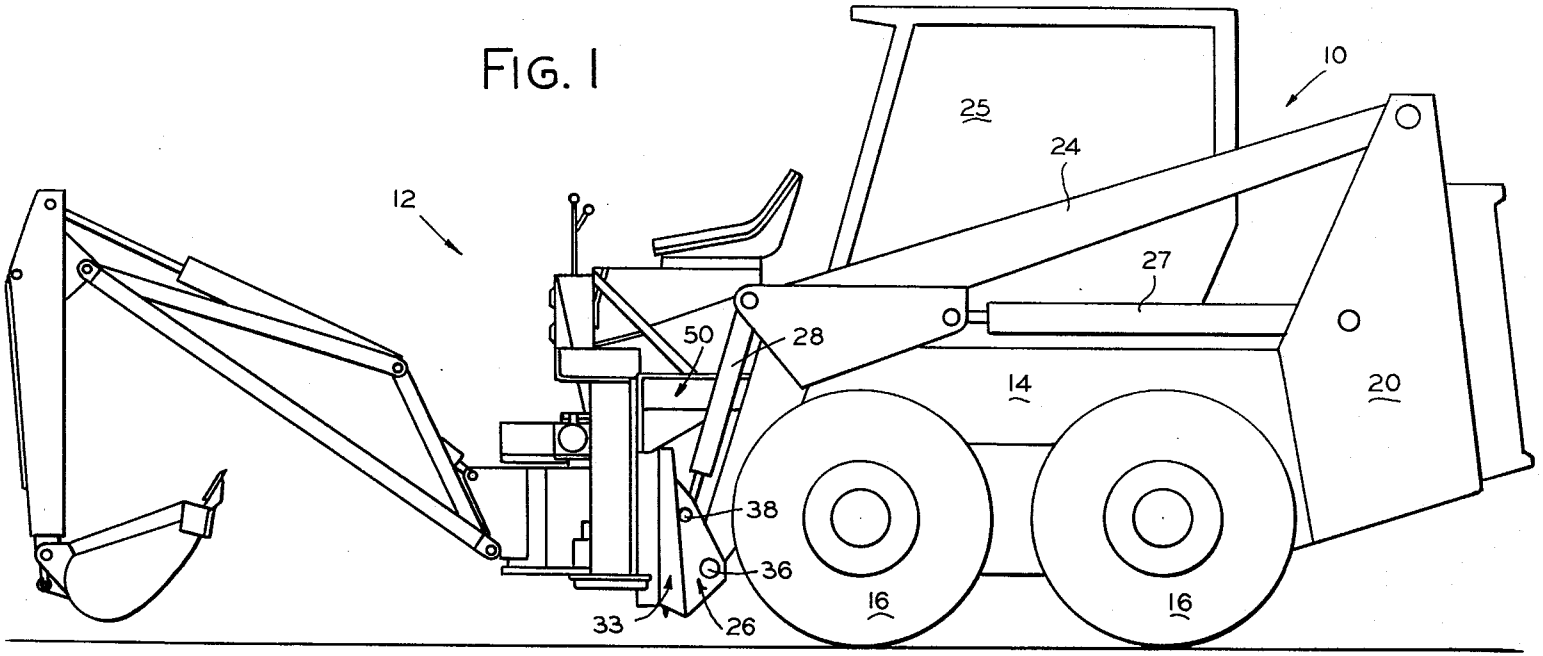
FIG. 1 is a side elevational view of a tractor vehicle of the type referred to as a compact skid-steered loader where the lift arms are lowered and supporting a backhoe.

Referring now to FIG. 1, skid-steered loader 10 has a backhoe 12 mounted on the front end. The vehicle 10 includes a body 14 and wheels 16 on opposite sides which are driven independently such that the loader is propelled and maneuvered or steered by driving the wheels on one side at speeds different from or in opposite directions to those on the opposite side which is often termed "skid-steering". Connected to the body 14 at the rear is a pair of stanchions 20 to which a pair of forwardly extending lift arms 24 is connected at the upper ends of the stanchions.

The lift arms 24 extend downwardly from the stanchions 20 alongside the operator's compartment 25 to a point near the front of the body 14 and then sharply downwardly at the front pivotally mounting at their forward ends a mounting frame 26. A pair of lift cylinders 27, one on each side, is pivotally connected at the rear to the stanchions 20 and at their rod ends to the lift arms 24 for raising and lowering the lift arms 24 and mounting frame 26. A pair of tilt cylinders 28, one on each side, is carried on the lift arms 24 and pivotally connected at their outer or rod ends to the mounting frame 26. Toe and heeled foot pedal controls at the operator's feet in the operator's station 25 are used for actuating the cylinders 27, 28.

Figure 2:
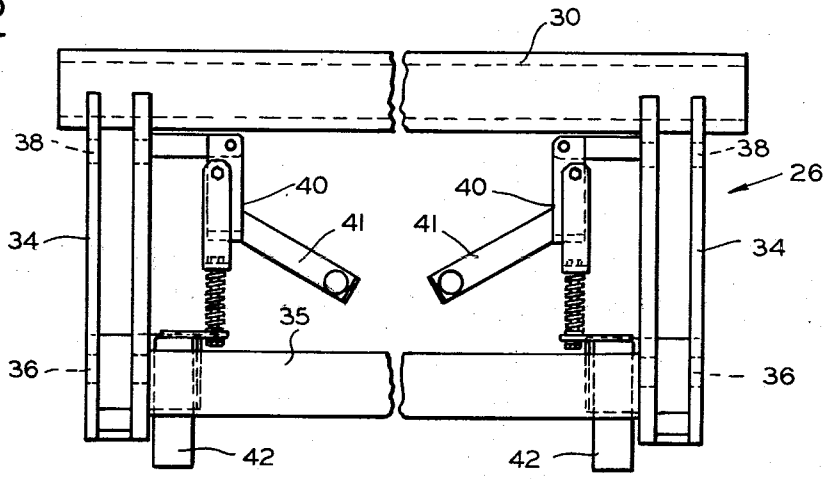
FIGS. 2 and 3 are partial rear and side views of the mounting frame pivoted on the ends of the lift arms.
Figure 3:
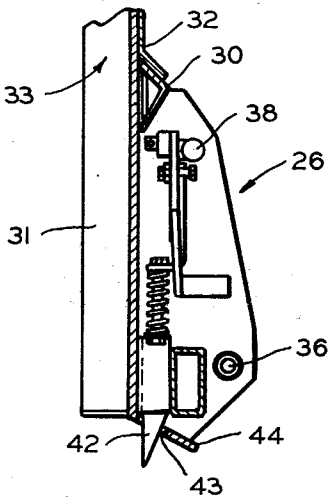

Referring to FIGS. 2 and 3, the mounting frame 26 includes a horizontally extending bar 30 at the top which is adapted to engage an upwardly converging carrier receiver 32 extending across the upright frame 31 of the attachment carrier 33 described more in detail below. The bar 30 is secured to a pair of upwardly extending brackets 34 spaced opposite the lift arms and connected by a cross brace 35 at the bottom. The frame 29 is pivotally connected at 36 to the lift arms. The cylinders 28 are connected at 38 to the brackets 34 for tilting the frame 26 about the pivot 36. The frame 26 also has a pair of latches 40 which can be operated by hand levers 41 to raise and lower a pair of wedges 42 at opposite ends of the cross brace 35. In the extended position, the wedges 42 project through openings 43 (FIG. 3) in a bottom plate 44 extending across the lower ends of the upright frame 31. A more detailed description of the of the mounting frame 26 may be found in the above referenced U.S. Pat. No. 3,672,521 and particularly FIGS. 11 and 12 and the description in that specification commending in column 7 at line 6 and ending in column 8 at line 39 which shall be considered as incorporated by reference in this specification. Briefly, the movement of the levers 41 upwardly as viewed in FIG. 2 causes actuation of an over-center spring mechanism said patent which movement causes the wedges 42 to slide upwardly out of engagement with the openings 43 and in which position the levers 41 will be extending generally upwardly near the top of the bar 30 and accessible to the operator from the operator's station 25 on the vehicle.

Figure 4:
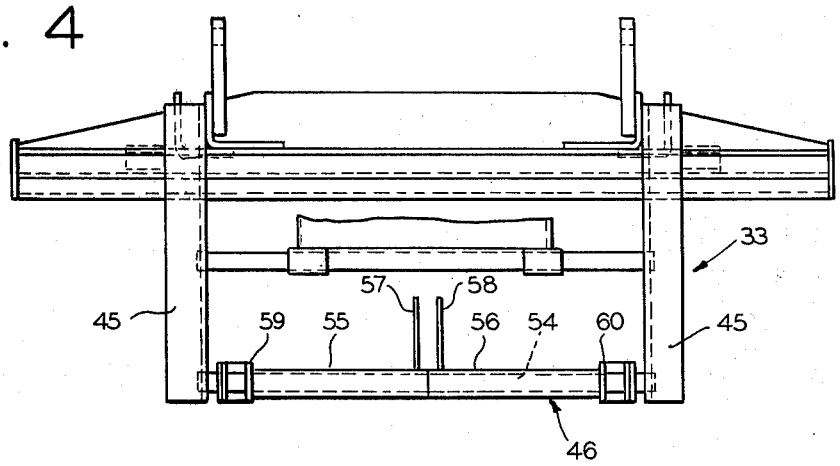
FIGS. 4, 5 and 6 are respectively plan, rear and side views of a portion of the backhoe or attachment carrier.
Figure 5:
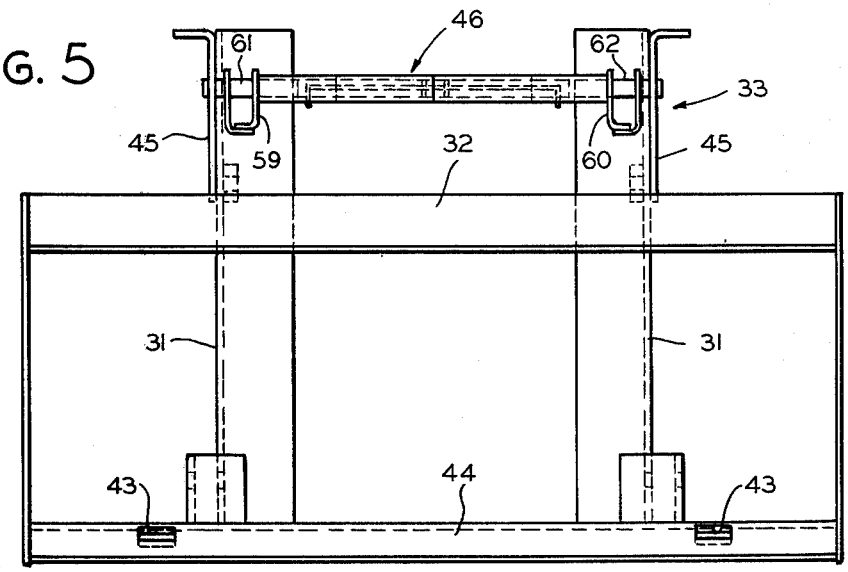
Figure 6:
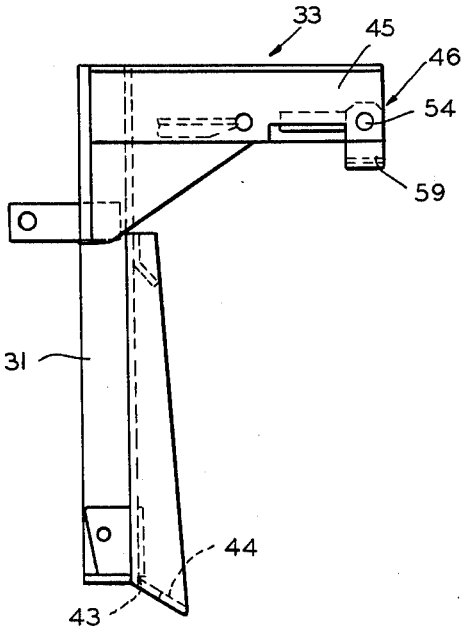

Referring now to FIGS. 4, 5 and 6, the carrier 33 has spaced upright attachment frames 31 connected across the bottom by the plate 44. Spaced upwardly on the uprights 31 and extending horizontally is the carrier receiver 32 forming an upwardly converging opening or angle on the loader side of the carrier 33 in which the horizontal bar 30 of the mounting frame 26 is received as depicted in FIG. 3. The uprights 31 extend above the bar 30 on the mounting frame 26 in the lowered position of the lift arms and with the attachment resting on the ground. The uprights 31 support rearwardly extending stabilizing elements or rails 45 spaced inwardly of the lift arms 24.

Figure 9:
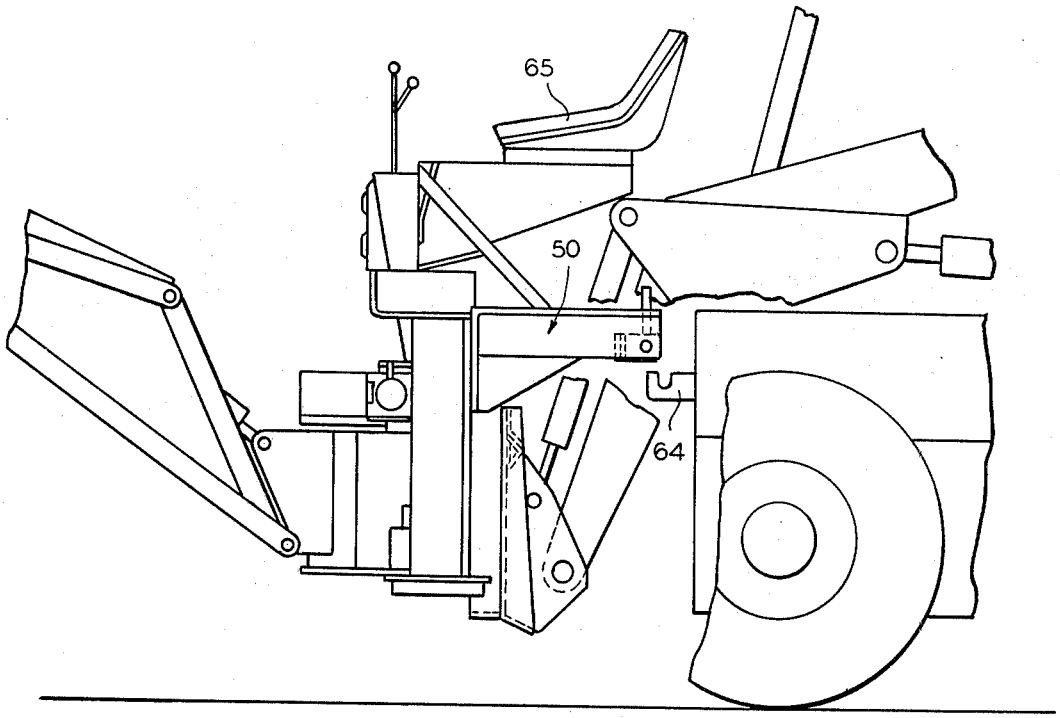

Supported between the rails 45 is a latch 46 comprising a fixed horizontal bar 54 having a pair of sleeves 55, 56 which are rotatably mounted thereon. Each sleeve 55, 56 has a lever 57, 58 (FIG. 4) adjacent the inner end and a U-shaped closures 59, 60 formed at the opposite end. The closures 59, 60 expose a portion of the shaft 54 forming lugs 61, 62. On the front of the vehicle body are a pair of spaced hooks 64 (FIG. 7) which are aligned with the lugs 61, 62. The closures 59, 60 are pivoted out of the way as shown in FIG. 9 when making the connection and are then pivoted around the hooks 64 as shown in FIG. 10 to lock the attachment and prevent drive of the cylinders 28, 27 which would otherwise occur due to the weight and working loads of the attachment.

Figure 7:
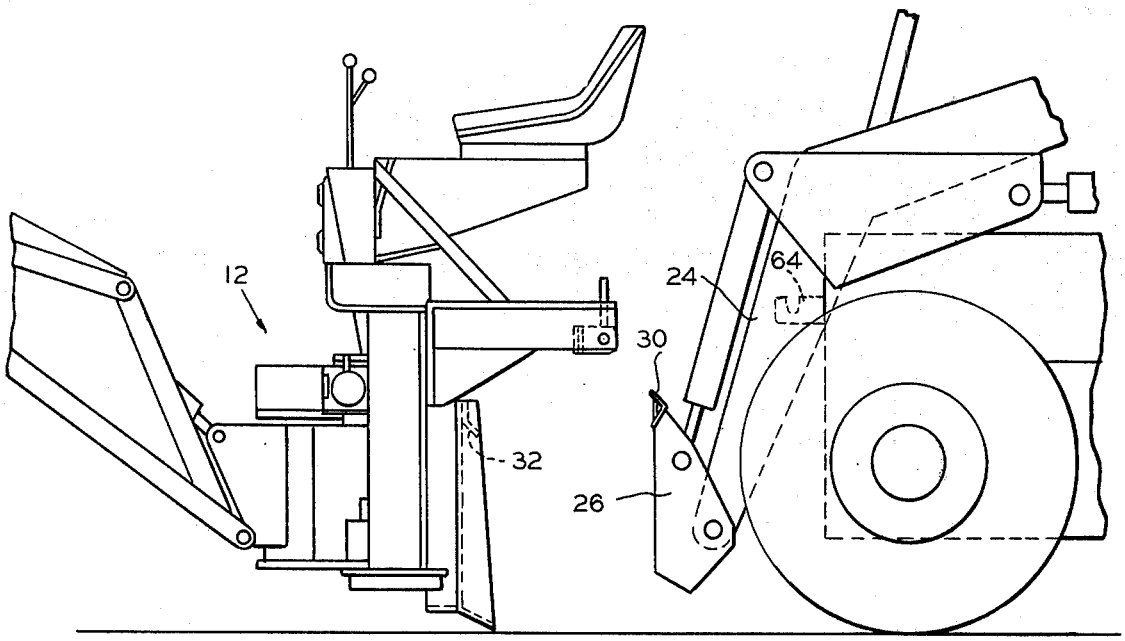
FIGS. 7, 8, 9 and 10 are sequential views showing the lifting, transferring and latching on the attachment in working position.
Figure 8:
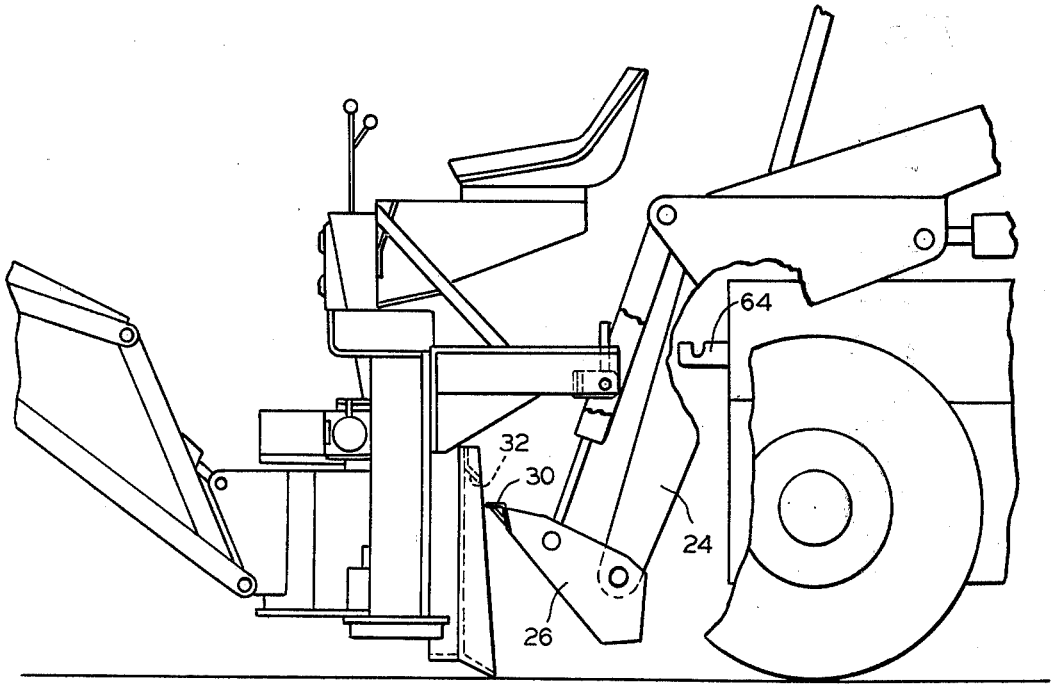
Figure 10:
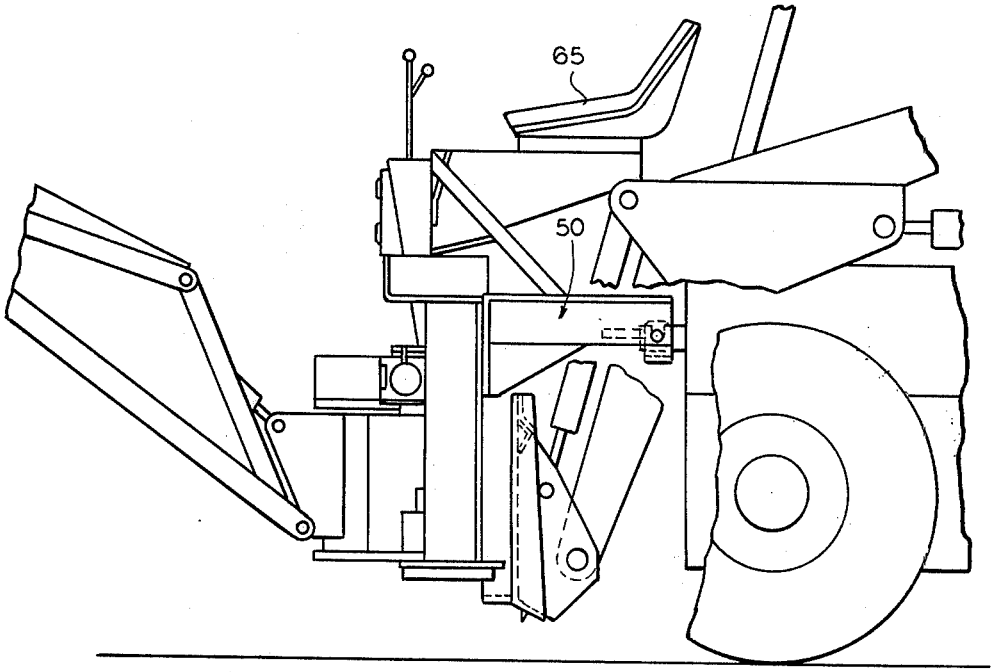

Referring now to FIGS. 7, 8, 9 and 10. It will be seen as depicted in FIG. 7 that the attachment 12 is resting on the ground while the loader 10, having previous dropped the bucket or other attachment, is approaching from the rear with the lift arms 24 lowered and the mounting frame 26 tilted back. As will be appreciated from the sequence of views in FIGS. 7 through 10, the operator has a view of the top bar 30 without leaving his seat. Thus from the operator's station he can manipulate the frame 26 and the arms 24 so as to tilt the frame 26 and bring the bar 30 below the carrier receiver 32. The attachment can then be lifted. As it is lifted, the attachment will simultaneously pivot bringing the plate 44 into a wedging engagement with the lower angled edges of the brackets 34. The wedges 42 will have previously been raised so that it is now only necessary for the operator to lean forward and depress the levers 41 which actuates the wedges 42 downwardly into the openings 43. The wedges 42 in FIG. 3 cooperate with the openings 43 in increasing the interference wedging action between the plate 44 and the carrier receiver 32 to insure that any loseness is taken up. This is the position depicted in FIG. 9. The operator remains in the vehicle compartment 25 and continues to manipulate the lift and tilt cylinders until the lugs 61, 62 can be dropped on the hooks 64 and the latch 40 engaged. With the lugs 61, 62 resting on the hooks 64 the operator turns the closures 59, 60 around the hooks 64 as depicted in FIG. 10. A cotter pin or key, not shown, is inserted in each hook to prevent the closures 59, 60 from working free.

Figure 11:
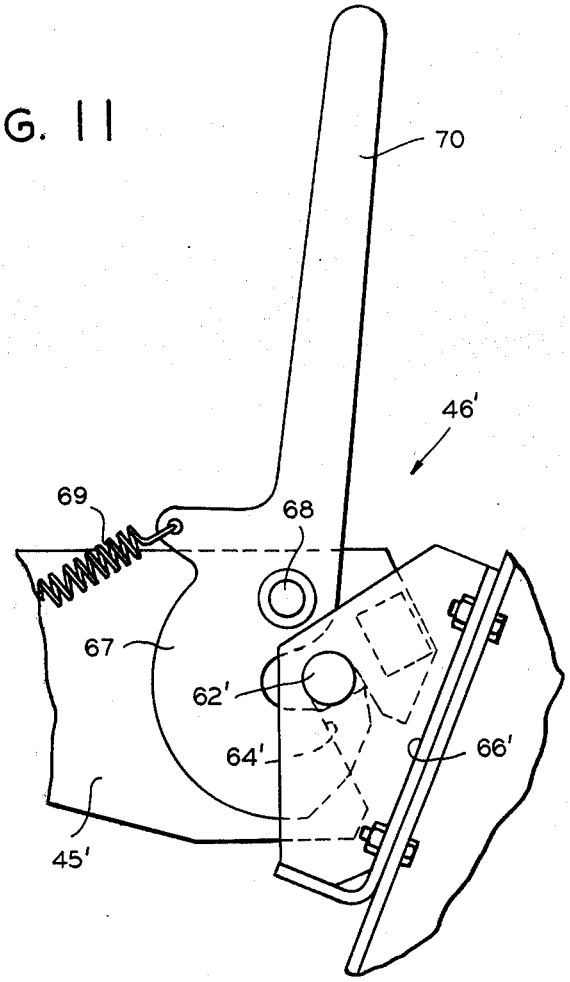
FIGS. 11 and 12 are partial, broken out, views showing a different latch embodiment.
Figure 12:
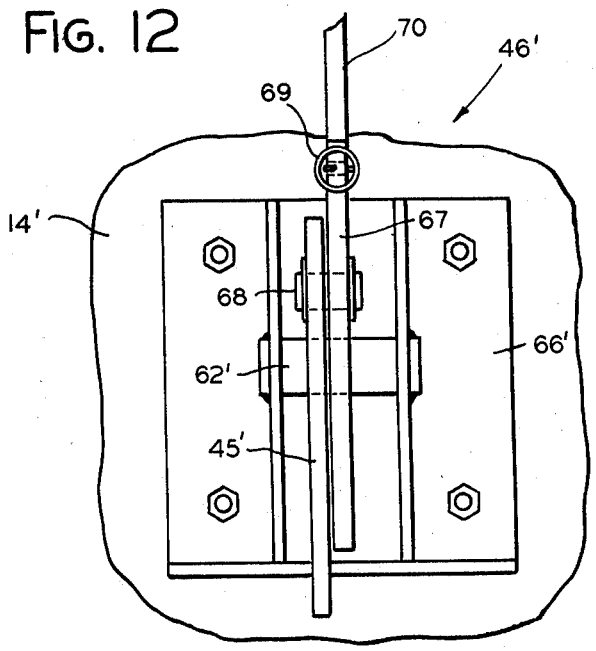

In another embodiment shown in FIGS. 11 and 12, a latch 46' comprises a pair of hooks or slots 64' formed in the rear of each rail 45' of the carrier which are received over a pair of lugs supported on bracket plates 66' mounted on the front of the loader body 14'. A closure hook 67 is pivoted at 68 on each rail and pulled toward the closed position by a tension spring 69. The closure hook 67 is pivoted out of the path of the slots 64' when making the connection with the lugs 62' by the operator pulling the lever 70 toward him. When the connection is made, the operator releases the closure hook is pulled by the spring 69 to the closed position shown in FIG. 11.

While alternate embodiments if my invention have been disclosed, it will be understood that these descriptions are for purposes of illustration only and that various modifications and changes can be made to my invention without departing from the spirit and scope of it. Therefore, the limits of my invention should be determined from the following appended claims.

What is claimed is:

1. For a tractor vehicle having lift arms pivoted on the vehicle, and hydraulic cylinders connected between the vehicle and lift arms for raising and lowering the arms, an attachment mounting comprising a mounting frame pivoted on the ends of the lift arms for carrying an attachment, hydraulic cylinders connected between the lift arms and mounting frame for pivoting the mounting frame relative to the lift arms, the lift arms and the mounting frame supporting the majority of the weight of the attachment in a work position, a carrier provided on the attachment for receiving the mounting frame, and a stabilizing element provided between the attachment and vehicle enabling the attachment to be locked in the work position in fixed relationship to the vehicle body, the stabilizing element comprising a rigid extension structure projecting rearwardly from the attachment to engage a latch means provided on the vehicle, the latch means operable between said structure and the vehicle with the attachment positioned in the work position to lock the attachment to the vehicle and to locate the lift arms and mounting frame in fixed relation to the vehicle with the attachment in the work position, the latch means permitting the attachment to be readily attached to the vehicle.

2. The mounting according to claim 1 wherein the latch means includes a pair of hooks spaced laterally on the vehicle having upwardly opening access thereto, a pair of laterally spaced lugs aligned with said hooks on said structure adapted to be received in said hooks by a downward motion of the structure and a closure means associated with each lug and pivotally mounted on said structure so as to be movable out of the way when lowering said lugs into said hooks and thereafter pivoted so as to close preventing escape of the lugs from the hooks.

3. The mounting according to claim 1 wherein the latch means comprises a pair of laterally spaced lugs mounted on the vehicle, said structure having a pair of slots aligned with said lugs and adapted to be received thereon by a downward movement of the structure in relation to the vehicle, a closure hook pivotally mounted on said structure adjacent each slot, and a spring urging the closure hooks toward the closed position such that the hooks may be manually moved out of the way against the force of said spring when mounting the attachment and thereafter released and returned by said spring to a locked position beneath said lugs when the attachment is in the work position.

4. For a tractor vehicle having lift arms pivoted on the vehicle, an attachment mounting comprising a mounting frame pivoted on the lift arms, a carrier provided on an attachment of the type where the lift arms are idle with the attachment in a work position, the carrier adapted to be connected to the mounting frame, the lift arms and the mounting frame supporting the majority of the weight of the attachment in the work position, and a stabilizing element enabling the attachment to be transferred to a work position by manipulating the lift arms and mounting frame including a structure extending rearwardly from the attachment and bridging between the attachment and vehicle above the mounting frame when the attachment is in a work position, said structure comprising a pair of rearwardly extending rail members spaced laterally a distance apart less than the spacing between said lift arms, said lift arms being pivotally mounted adjacent the rear of the vehicle and extending forwardly along side the operator's compartment and then sharply downwardly at the front of the vehicle, a latching means operable between each rail member and said vehicle to lock the attachment to the vehicle and locate the lift arms and mounting frame and attachment carried thereby in fixed relation to the vehicle when the attachment is in the work position comprising a hook means engageable with a lug means by downward movement of the structure and a closure pivotally associated with each hook and lug means operable for locking said means in the work position, the latching means permitting the attachment to be readily attached to the vehicle.

5. The mounting according to claim 4 wherein the latch means comprises a horizontal shaft extending between said rail members, a pair of rotatable sleeve members mounted an opposite ends of said shaft, each having a U-shaped closure at one end and an operating handle at the opposite end and a pair of hooks mounted on the vehicle opening upwardly and aligned with said U-shaped closure members, said operating handles being accessible to the operator's station on the machine in the work position permitting the closure members to be rotated out of the way when engaging the hooks and with the attachment in the work position rotated in the opposite direction around the hooks in the locking position.

6. The mounting according to claim 4 wherein the latch means comprises a pair of slots, one formed in each of said rail members, and a pair of lugs aligned with each slot mounted on the vehicle adapted to be received in the slot in the work position, and a closure hook pivotally mounted adjacent each slot on the rail members having a rearwardly opening hooked mouth, a spring biasing the closure hook toward the locking position, and a manually operated handle accessible from the operator's station on the machine enabling the operator to retract the closure hook against the force of said spring when engaging the lugs and slots and release the closure to the locked position when the attachment is located in the work position.

7. The method of mounting an attachment on a tractor vehicle where said vehicle comprises a compact body having an engine at the rear, an operator's compartment in the middle, and a space for the operator's legs at the front, a pair of lift arms pivotally mounted at the rear extending forwardly along side the operator's compartment and abruptly downward at the front of the vehicle in the lowered position, a mounting frame pivoted on the lift arms, lift and tilt cylinders for raising and lowering the lift arms and tilting the mounting frame controlled by foot pedals in the space forward of the operator, an attachment of the type where the lift arms and mounting frame are idle and support the majority of the weight of the attachment when the attachment is in the work position, a carrier provided on the attachment and adapted to be connected to the mounting frame, a rigid structure enabling the attachment to be transferred and located in a work position on the vehicle by manipulating the lift arms and mounting frame under the control of the operator's foot pedals, the method comprising the steps of positioning the rigid structure between the lift arms so as to bridge the distance between the attachment and the vehicle at a level above the mounting frame and a pair of spaced locating devices on the vehicle, lowering the rigid structure into engagement with said locating devices and engaging a latching means to lock said structure and locating devices in ready attachment to the vehicle without requiring the dismounting of the operator from the operator's compartment.

* * * * *